US006056543A

United States Patent [19]

Taricco

[11] Patent Number: 6,056,543

[45] Date of Patent: May 2, 2000

[54] ARTICLE TRANSPORT SYSTEM

[76] Inventor: Tari Taricco, 1520 W. 16th St., Long Beach, Calif. 90813

[21] Appl. No.: 08/935,356

[22] Filed: Sep. 22, 1997

[51] Int. Cl.[7] ..... F27D 3/00

[52] U.S. Cl. ..... 432/239; 432/239; 198/433; 198/448; 198/456

[58] Field of Search ..... 198/406, 433, 198/448, 456, 467.1, 486.1, 680; 432/239

[56] References Cited

U.S. PATENT DOCUMENTS

| | | | |
|---|---|---|---|
| 801,523 | 10/1905 | Hinchman et al. | 198/476.1 |
| 1,282,741 | 10/1918 | Borger | 198/637 |
| 1,500,776 | 7/1924 | Spooner | 198/377.02 |
| 1,930,607 | 10/1933 | Brown | 198/377.06 |
| 3,033,342 | 5/1962 | Kinnicutt, Jr. | 198/431 |
| 5,154,275 | 10/1992 | Speckhart et al. | 198/416 |

*Primary Examiner*—Christopher P. Ellis
*Assistant Examiner*—Jeffrey A. Shapiro
*Attorney, Agent, or Firm*—Blakely, Sokoloff, Taylor & Zafman

[57] ABSTRACT

A transport system operates to convey articles preferably through an oven before their subsequent removal. The transport system is synchronized with an article delivery system to receive and subsequently convey articles for final distribution on one or more conveyor belts. This is accomplished by drive mechanism which rotates a plurality of support bars having hooks. These hooks are used to catch articles as they are provided to the transport system and retain these articles during conveyance. An adjustable chute is used to impede the conveyance of only the articles. This causes the articles to be removed from the hooks and slide down the chute to the conveyor belt(s).

19 Claims, 8 Drawing Sheets

8
320
300
310
321
330
400
220
420
410
8

ARTICLE TRANSPORT SYSTEM

BACKGROUND OF THE INVENTION

1. Field of the Invention

The present invention relates to a system and method for transporting articles from one location to another. More particularly, the preferred embodiment of the present invention relates to a transport system used to convey one or more articles through an oven for curing.

2. Background of Art Related to the Invention

The preferred embodiment of the present invention is intended for transporting automatic transmission friction plates through an oven to cure the resin impregnating the friction material bonded thereto. Accordingly, while the present invention may be used for transporting numerous articles, only the prior art related to the preferred embodiment and use of the present invention will be discussed.

For many years, automatic transmission friction plates have been produced in large quantities for many types of vehicles. These automatic transmission friction plates are manufactured by bonding friction material to appropriately configured metal rings and then impregnating the friction material with a suitable resin. Thereafter, each friction plate is exposed to a sufficient heat to cure the resin. The curing of the resin is accomplished by transporting the friction plate through an oven at a suitable temperature, the transit time being adequate to cure the resin.

In the prior art, these friction plates have been mass-produced through the use of a conventional transport system, including robotic equipment operating in combination with a conveyor belt. The robotic equipment (e.g., a robotic arm) actively removes the impregnated friction plates from a lead screw delivery mechanism and rotates each friction plate about an axis perpendicular to the axis of the friction plate for placement flat on the conveyor belt. The conveyor belt then transports the friction plates along a horizontal plane through an oven for the curing operation. Thereafter, the friction plate is removed from the conveyor belt and packaged.

This conventional transport system possesses a number of disadvantages. For example, robotic equipment as currently used is incapable of supporting production rates greater than current levels. Additionally, conventional robotic equipment is expensive, not easily maintained, and quite difficult to synchronize with other delivery mechanisms due to its overall complexity. Also, transporting the friction plates flat on the conveyor through the oven is not the most efficient use of the oven volume because of the inability to stack the friction plates on the conveyor.

SUMMARY OF THE INVENTION

A transport system for receiving and conveying articles or example, conveying automatic transmission friction plates through an oven for curing. In one embodiment, the transport system is designed to operate in conjunction with a drive mechanism to rotate a plurality of support bars having hooks. These hooks are used to catch articles as they are provided to the transport system and retain these articles during conveyance. An adjustable chute may be used to make contact only with the articles during conveyance. This causes the articles to be removed from the hooks for subsequent loading on one or more conveyor belts.

BRIEF DESCRIPTION OF THE DRAWINGS

The features and advantages of the present invention will become apparent from the following description of the present invention in which.

DESCRIPTION OF THE PREFERRED EMBODIMENT

The present invention relates to a transport system and its corresponding method of operation used to convey one or more articles from one location to another. In following detailed description, specific details are set forth for illustration purposes in order to ensure understanding of the present invention. Of course, it would apparent to one skilled in the art that the present invention may be practiced while deviating from these specific details. Furthermore, it should borne in mind that the present invention should not be limited solely in connection with the production of automatic transmission friction plates, but may be utilized for other type of articles.

In the following description, some terminology is used to generally describe certain features of the transport system. For example, a "drive mechanism" may include, but is not limited or restricted to, one or more adjustment chains formed by connecting together multiple chain links. The drive mechanism is made of metal (e.g., stainless steel), but could be made of plastic or any other wear-resistant, thermally conditioned material. A "hook" is an instrument capable of retaining an article during conveyance. A "support bar" is any physical structure capable of being moved by the drive mechanism. An "article" is defined as any item capable of being transported by a hook such as an automatic transmission friction plate for example. An article used for the illustrative embodiment of the present invention would also have a thermal tolerance of any temperature imposed by an oven during a curing process.

Figure 1:
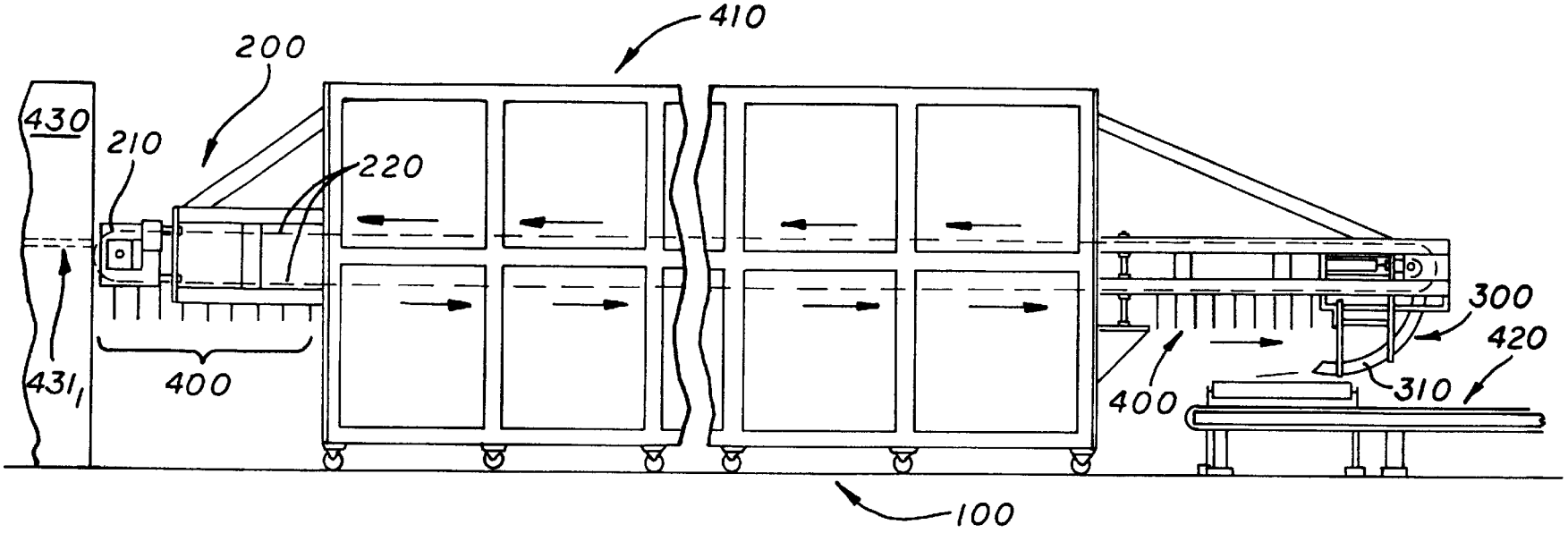
FIG. 1 is an illustrative embodiment of the transport system.

Referring to FIG. 1, the transport system 100 can be viewed as having a loading end 200 and an unloading end 300. In this embodiment, both ends 200 and 300 collectively operate to convey articles 400 through an oven 410 and to place these articles onto one or more conveyor belts 420. The transport system 100 is configured to receive one or more articles 400 from an article delivery system 430. Well known in the art, article delivery system 430 includes one or more lead screws each having a helical groove, although only lead screw $\mathbf{431}_1$ is shown for clarity sake. The rotation of lead screw $\mathbf{431}_1$ causes articles 400 to be propagated toward the loading end 200 of transport system 100.

In synchronism with the operations of article delivery system 430, the loading end 200 includes a drive unit 210 which continuously rotates a drive mechanism 220 represented by dashed lines. As shown, drive mechanism 220 is rotated along one or more vertical plane(s) in a counter-clockwise direction between the loading end 200 and the unloading end 300 of transport system 100. This enables articles 400 to be propagated from article delivery system 430 to a distant location after passing through oven 410. Upon being cured in oven 410, articles 400 are propagated to the unloading end 300 which features a chute 310 that causes articles 400 to be placed on one or more conveyor belts 420.

Figure 2:
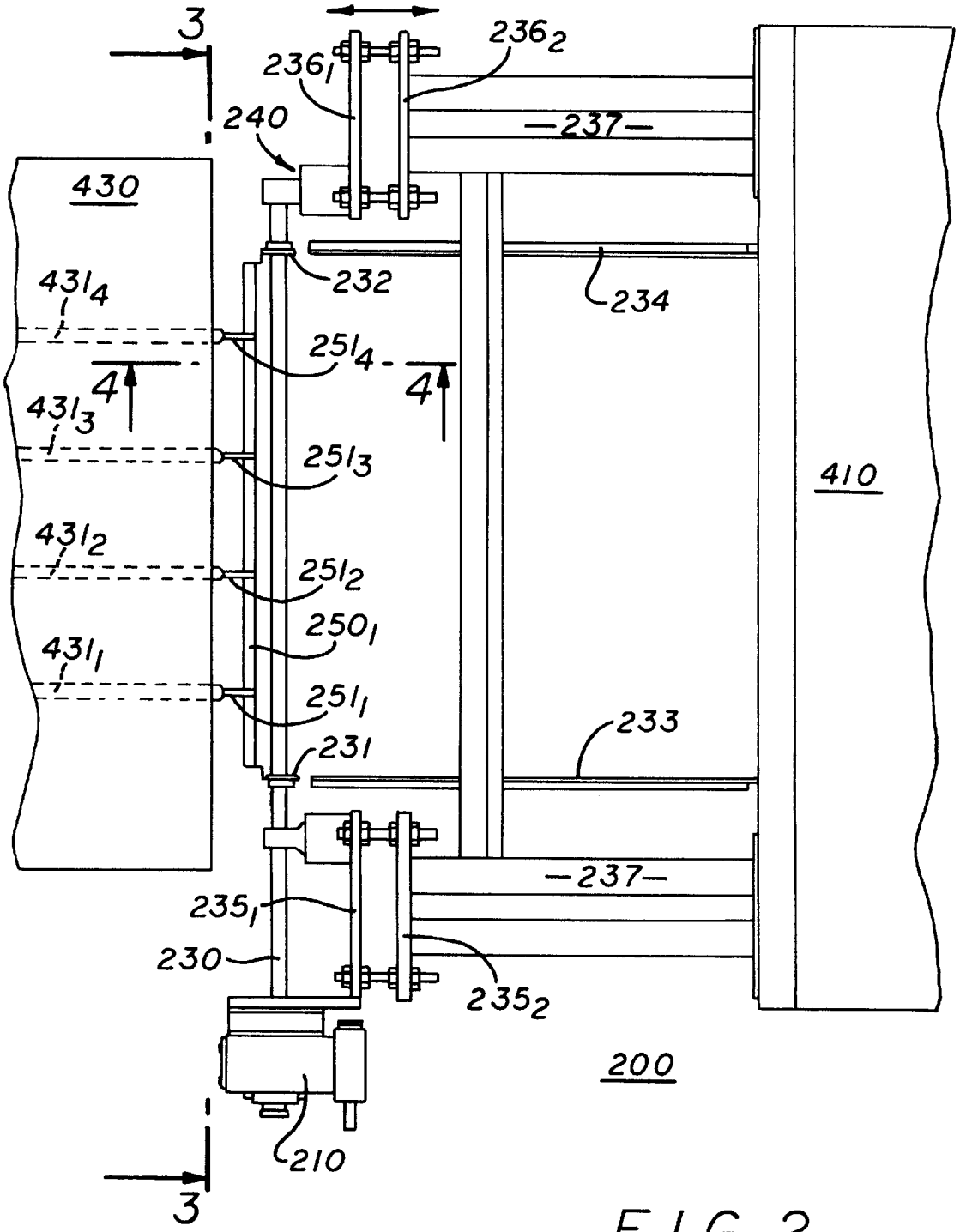
FIG. 2 is a top plan view of the embodiment of the loading end of the transport system in which articles are conveyed to an oven of FIG. 1.

Referring now to FIG. 2, a top plan view of loading end 200 is shown. The loading end 200 includes a drive unit 210 and a drive shaft 230 rotatably connected to both drive unit 210 and to a drive shaft support unit 240. A pair of sprockets 231 and 232 are placed on drive shaft 230 and are generally aligned with corresponding sets of drive supports 233 and 234 partially shown in FIG. 5. The sprockets 231 and 232 are used to rotate the drive mechanism (e.g., a pair of adjustment chains each uniquely driven by sprockets 231 and 232) along drive support sets 233 and 234, respectively. In general, the drive support sets 233 and 234 partially or completely extend from drive shaft 230 to a complementary shaft at the unloading end. The drive support sets 233 and 234 and may be lubricated, if necessary, to reduce wear on the adjustment chains.

The horizontal positioning of drive shaft 230 in proximity to the drive support sets 233 and 234 can be slightly adjusted by a pair of drive adjustment plates $\mathbf{235}_1$–$\mathbf{235}_2$ and $\mathbf{236}_1$–$\mathbf{236}_2$. Namely, through screw adjustment of the spacing between each adjustment plate $\mathbf{235}_1$–$\mathbf{235}_2$ or $\mathbf{236}_1$–$\mathbf{236}_2$, the positioning of drive shaft 230 can be adjusted to increase or decrease tension (slack) of the drive mechanism. The drive support sets 233 and 234 (see FIG. 5) and drive adjustment plates $\mathbf{235}_1$–$\mathbf{235}_2$ and $\mathbf{236}_1$–$\mathbf{236}_2$ are attached to a frame 237 at the loading end 200.

Figure 3:
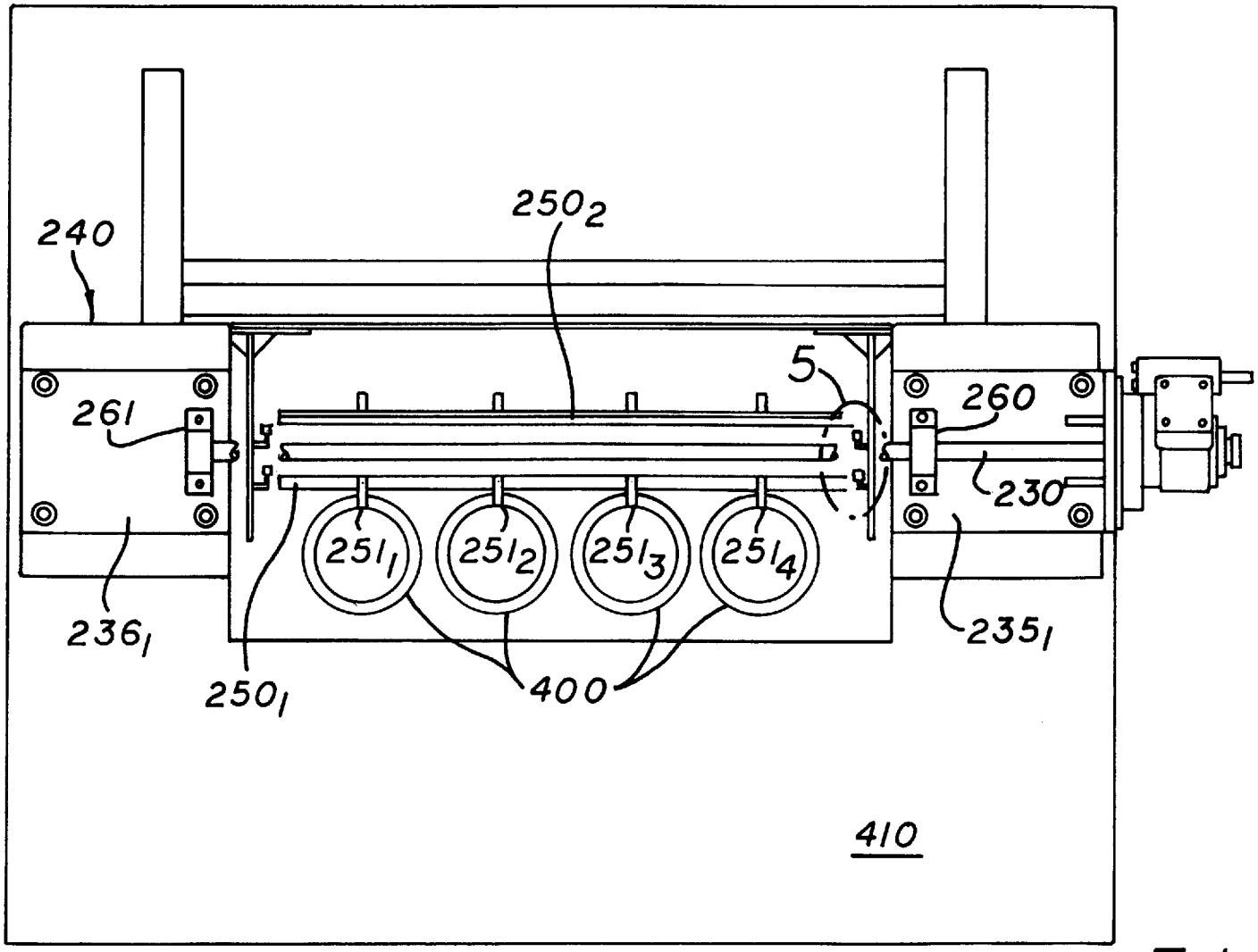
FIG. 3 is an front elevated view of the loading end of the transport system taken along lines 3—3 of FIG. 2.
Figure 4:
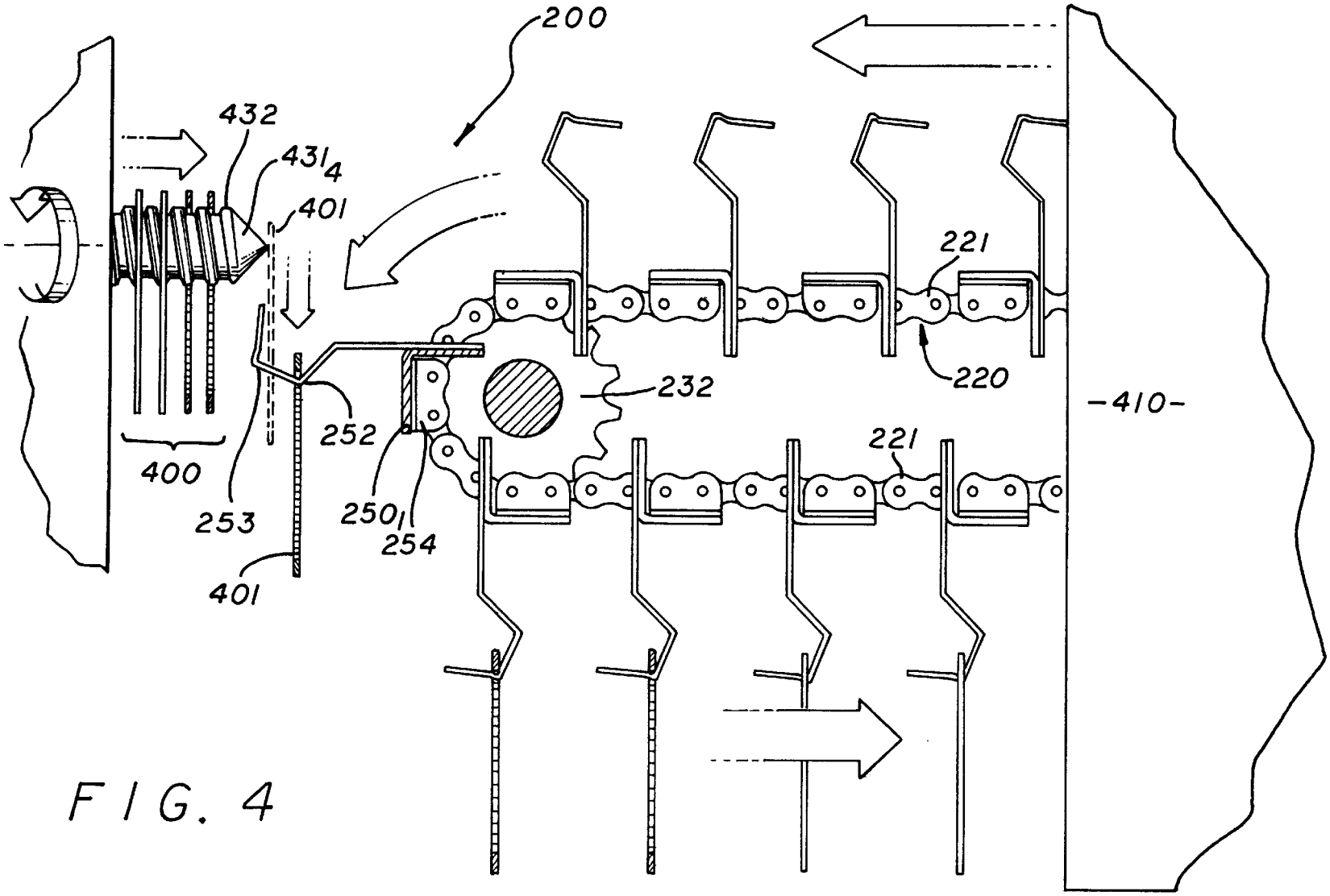
FIG. 4 is a side view of the loading end of the transport system taken along lines 4—4 of FIG. 2.

The drive unit 210 receives power from a motor (not shown) and adjusts the rotational speed of drive shaft 230. The adjustment of the rotational speed of drive shaft 230, which corresponds to the rotational velocity of sprockets 231 and 232, determines the rotational speed of the drive mechanism. As shown, support bar $\mathbf{250}_1$ is attached to the drive mechanism and is moved toward article delivery system 430 to receive articles (e.g., automatic transmission friction plates with friction material impregnated with resin) arriving by multiple lead screws $\mathbf{431}_1$–$\mathbf{431}_n$ (where "n" is a positive whole number indicating that one or more articles can be conveyed at a time; n=4 in this embodiment). Hooks $\mathbf{251}_1$–$\mathbf{251}_n$ (n=4 in this embodiment) are attached to support bar $\mathbf{250}_1$ and are generally aligned with lead screws $\mathbf{431}_1$–$\mathbf{431}_4$ to receive articles as shown in FIGS. 3–4. Although not shown in FIG. 2, it is contemplated that m support bars $\mathbf{250}_1$–$\mathbf{250}_m$ ("m" is a positive whole number) are attached to the drive mechanism and appropriately spaced apart from each other to support repetitive conveyance of articles.

Referring now to FIG. 3, a front elevated view of first subsystem 200 taken along line 3—3 of FIG. 2 is shown. In this embodiment, drive shaft 230 remains in a generally horizontal position by support bearings 260 and 261 attached to adjustment plates $\mathbf{235}_1$ and $\mathbf{236}_1$. This ensures proper alignment of an incoming support bar $\mathbf{250}_1$ and its hooks to catch articles released from the article delivery system and also enables proper adjustment in the tension of the drive mechanism (not shown). As shown, multiple articles have been placed on each hook $\mathbf{251}_1$–$\mathbf{251}_4$ of support bar $\mathbf{250}_1$ to be transferred through oven 410. These hooks $\mathbf{251}_1$–$\mathbf{251}_4$ are arranged in such a fashion such that they receive an article as it is released from a corresponding lead screw as shown in FIG. 4.

Referring to FIG. 4, articles 400 are propagated to the loading end 200 by one of many lead screws such as lead screw $\mathbf{431}_4$. Upon reaching the end of lead screw $\mathbf{431}_4$, one of these articles (e.g., article 401 depicted with dashed lines) is freed from the helical groove 432. The drive unit 210 of loading end 200 is synchronized with article delivery system 430 to retain articles as they are dropped from lead screws (e.g., lead screw $\mathbf{431}_4$). For example, hook $\mathbf{251}_4$ associated with support bar $\mathbf{250}_1$ would retain article 401 during at least two article loading states. The first loading state is when hook $\mathbf{251}_4$ is generally parallel to lead screw $\mathbf{431}_4$ and initially receives article 401. The second loading state is when article 401 is generally orthogonal to lead screw $\mathbf{431}_4$ as article 401 is conveyed to the unloading end.

In this embodiment, article 401 is normally maintained within a first recessed junction 252 of hook $\mathbf{251}_4$ during the first loading state. As shown, article 401 is shifted from a first recessed junction 252 to a second recessed junction 253 when hook $\mathbf{251}_4$ becomes generally orthogonal to lead screw $\mathbf{431}_4$. At this second recessed junction 253, article 401 will be retained by hook $\mathbf{251}_4$ until removal at the unloading end.

As further shown in FIG. 4, multiple support bars are attached to the drive mechanism 220. As briefly mentioned, one embodiment of the present invention features drive mechanism 220 including a plurality of adjustment chains of which only a first adjustment chain 221 associated with sprocket 231 is shown in FIG. 4. Each support bar (e.g., support bar $\mathbf{250}_1$) is coupled to a selected link of adjustment chain 221 by a fastener 254. Of course, the support bars are further coupled to a selected link of a complementary, second adjustment chain (not shown). Each of the hooks associated with its support bar is arranged to protrude therefrom in a direction generally orthogonal from the orientation of its support bar as shown.

Figure 5:
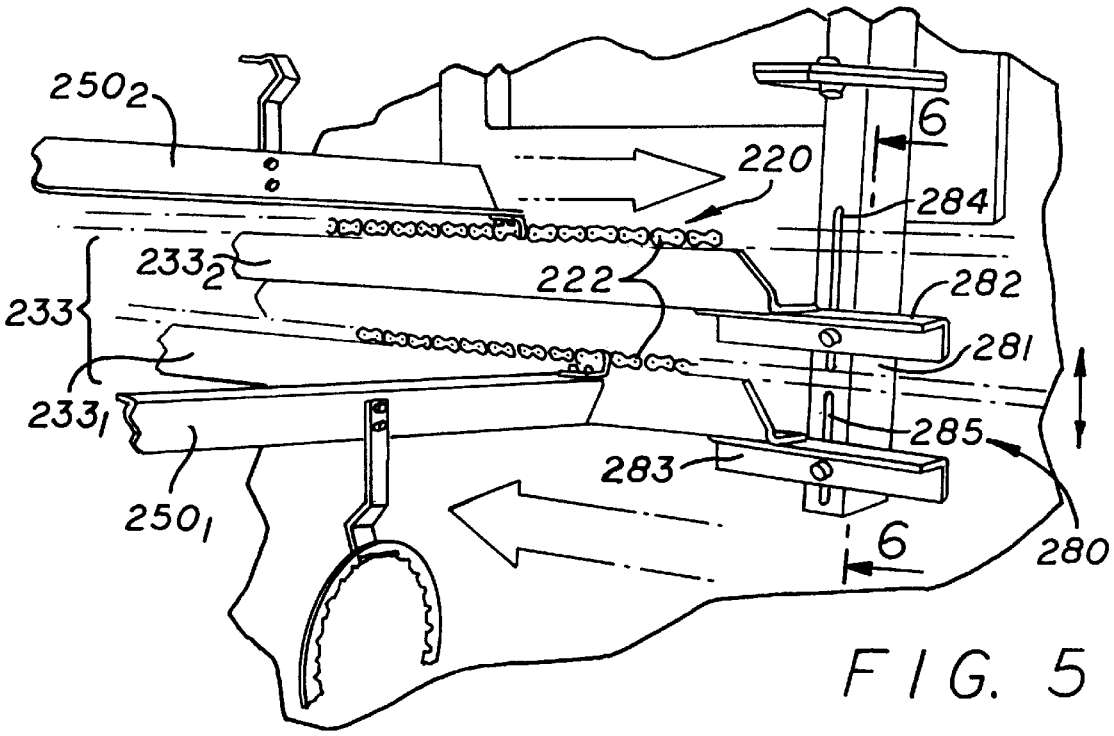
FIG. 5 is an enlarged perspective view of the loading end of the transport system along area 5 of FIG. 3.

Referring now to FIG. 5, an enlarged perspective view of the first subsystem along area "5" of FIG. 3 is shown. It is contemplated that a corresponding area, proximate to drive shaft support unit 240, has a similar construction. Herein, two support bars $\mathbf{250}_1$ 1 and $\mathbf{250}_2$ are shown to be attached to drive mechanism 220 which is illustrated in part as the second adjustment chain 222. The second adjustment chain 222 is glided over drive support set 233 including an outgoing drive support $\mathbf{233}_2$ and an incoming drive support 2332. The drive supports $\mathbf{233}_1$ and $\mathbf{233}_2$ enable adjustment chain 222 to be rotated in a direction according to the arrows so that an empty support bar $\mathbf{250}_2$ approaches article delivery system 430 and an article loaded support bar $\mathbf{250}_1$ 1 is directed toward the unloading end. The hooks are affixed to their respective support bars $\mathbf{250}_1$ 1 and $\mathbf{250}_2$ through any conventional fastening technique such as rivets, soldering, nuts/bolts, adhesive and the like.

Figure 6:
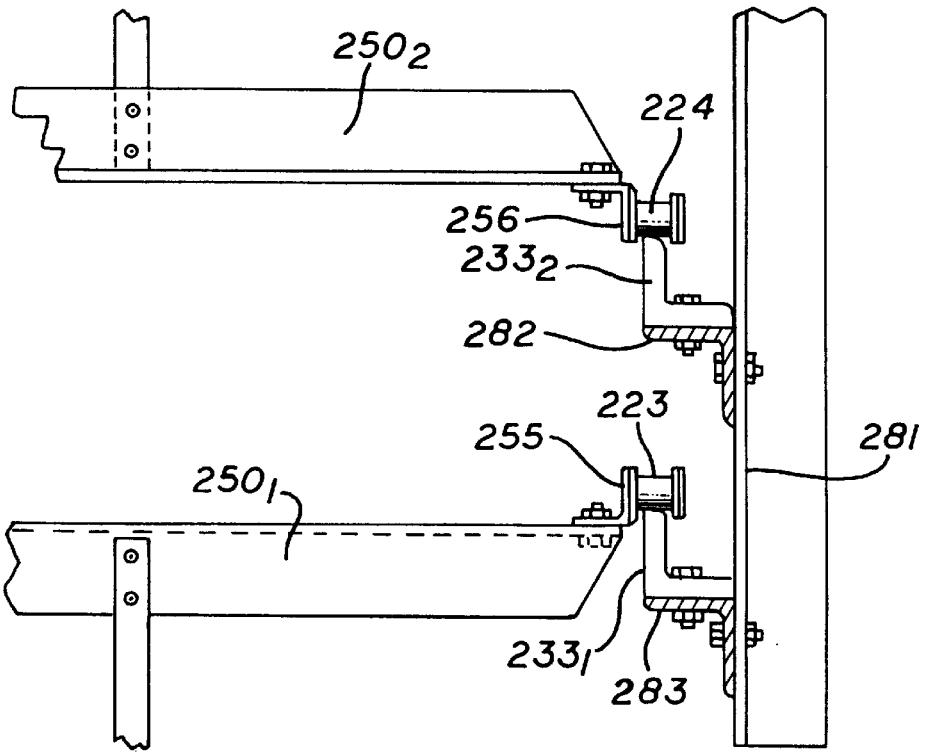
FIG. 6 is a sectional view of the loading end of the transport system taken along line 6—6 of FIG. 5.

The drive supports $\mathbf{233}_1$ and $\mathbf{233}_2$ are maintained generally horizontal to the ground by a securing member 280 attached to frame 237. The securing member 280 includes a stationary member 281, a first positioning member 282, and a second positioning member 283. Attached to frame 237, stationary member 281 includes a pair of slits 284 and 285 which provide a mechanism for the first and second positioning members 282 and 283 to be attached to stationary member 281. In this embodiment, attachment is through a conventional fastening technique such as, for example, a bolt capable of being inserted through its corresponding slit 284 or 285 and a hex-nut rotatably coupled to the bolt and tightened as shown in FIG. 6. It is contemplated, however, that other conventional fastening techniques may be used.

As further shown in FIG. 6, support bars $\mathbf{250}_1$ and $\mathbf{250}_2$ are coupled to fastening members 255 and 256 which are attached to selected links 223 and 224, respectively. These fastening members 255 and 256 are attached to links 223 and 224. Through this mechanisms, support bars $\mathbf{250}_1$–$\mathbf{250}_m$ are rotated throughout the transport system 100 by the rotation of the drive mechanism and are appropriately spaced from intermittently placed securing members to account for expansion of the support bars when exposed to high temperatures in the oven.

Figure 7:
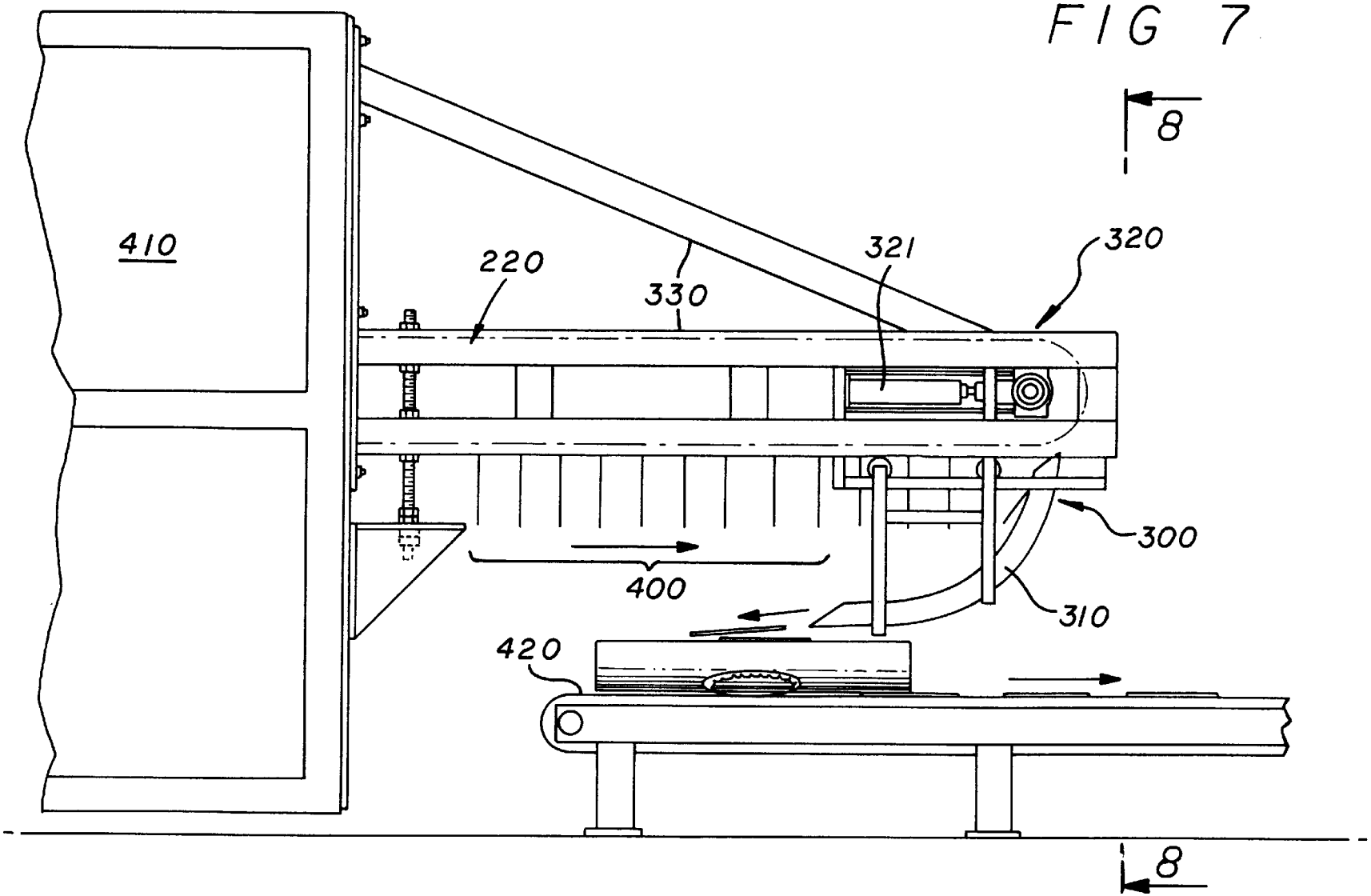
FIG. 7 is a side elevated view of the unloading end of the transport system of FIG. 1.

Referring now to FIG. 7, a side elevated view of the unloading end 300 of transport system 100 is shown. The unloading end 300 features a chute 310 attached to a frame 330. Adjustable to accommodate for articles of different sizes, chute 310 causes incoming articles 400 from oven 410 to be removed from hooks attached to supports bars. This removal process is described in detail with reference to FIG. 9. The unloading end 300 further features a complementary shaft 320 which is also attached to the frame 330.

Figure 8:
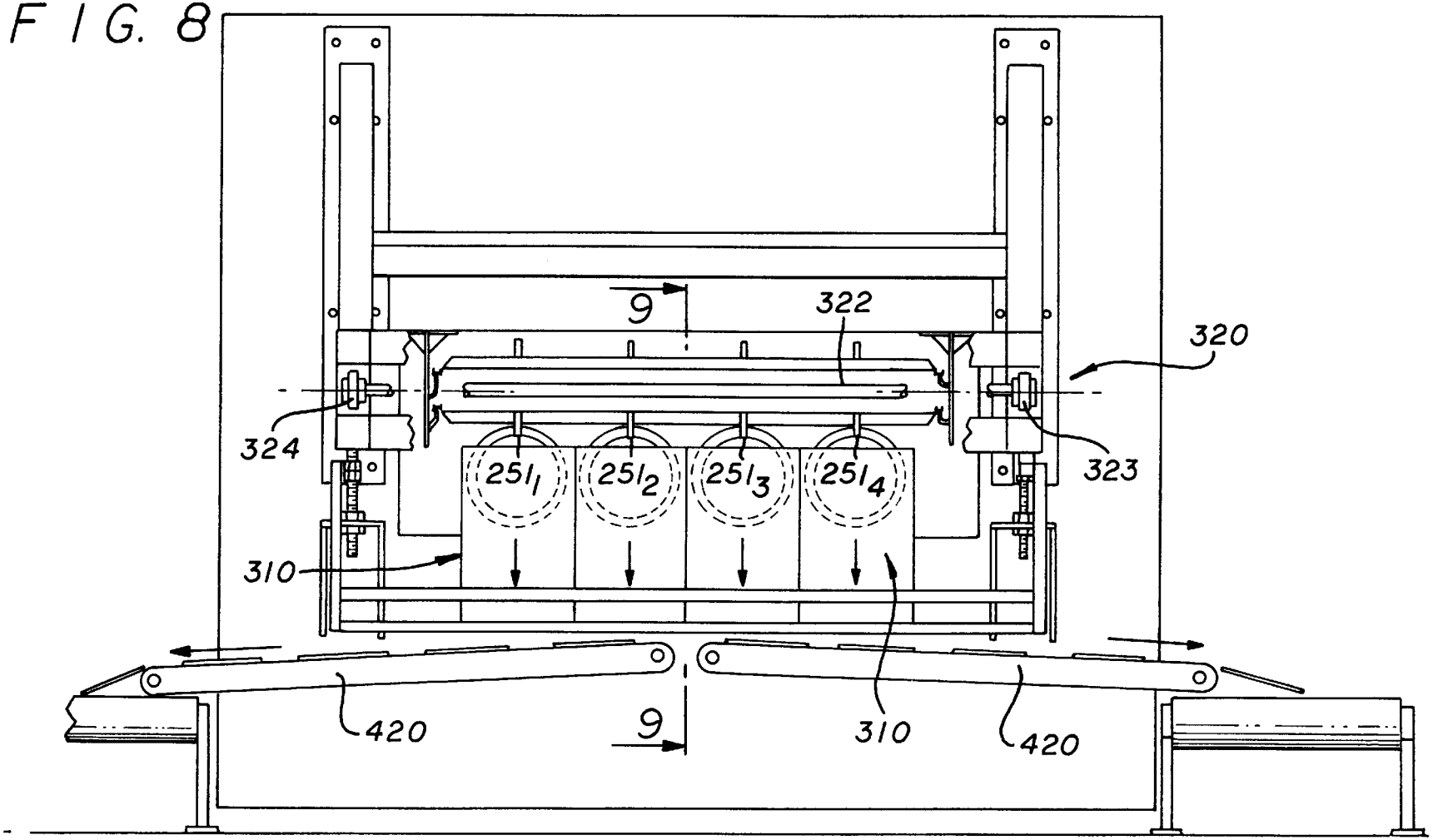
FIG. 8 is an rear elevated view of the unloading end of the transport system taken along line 8—8 of FIG. 7.

The complementary shaft 320 includes a pneumatic or spring resistive element 321 (e.g., pneumatic shock) to adjust tension of drive mechanism 220 by applying a pushing force against shaft 320. Alternatively, tension can be adjusted by applying a pulling force on shaft 320 if resistive element 320 is rotated 180°, and, thus, is placed on an opposite side of shaft 320. As shown in FIG. 8, an elevated view of the illustrative embodiment of the unloading end 300 in accordance with cross-sectional lines 8—8 of FIG. 7, complementary shaft 320 operates in a manner similar to the drive shaft unit of FIG. 2 using a shaft 322, sprockets 323 and 324, and drive support sets (not shown). However, the shaft 322 is not rotated by a drive unit powered by a motor. Instead, the shaft 322 is rotated by the drive mechanism 220 driven by the loading end. It is contemplated, however, that the drive unit may be connected to the drive shaft 322 in lieu of (or even in addition to) being connected to drive shaft 230 of the loading end 200.

As further shown in FIG. 8, chute 310 is designed with "n" sections raised to a sufficient height so that hooks $\mathbf{251}_1$–$\mathbf{251}_n$ (n=4 for this embodiment) of support bar $\mathbf{250}_1$ fail to make contact with the chute 310; however, a portion of articles 400 generally proximate to the hook comes into contact with chute 310 as the hook continues to rotate. This causes articles 400 to be removed from hooks $\mathbf{251}_1$–$\mathbf{251}_4$ and transferred to one or more awaiting conveyor belts 420.

Figure 9:
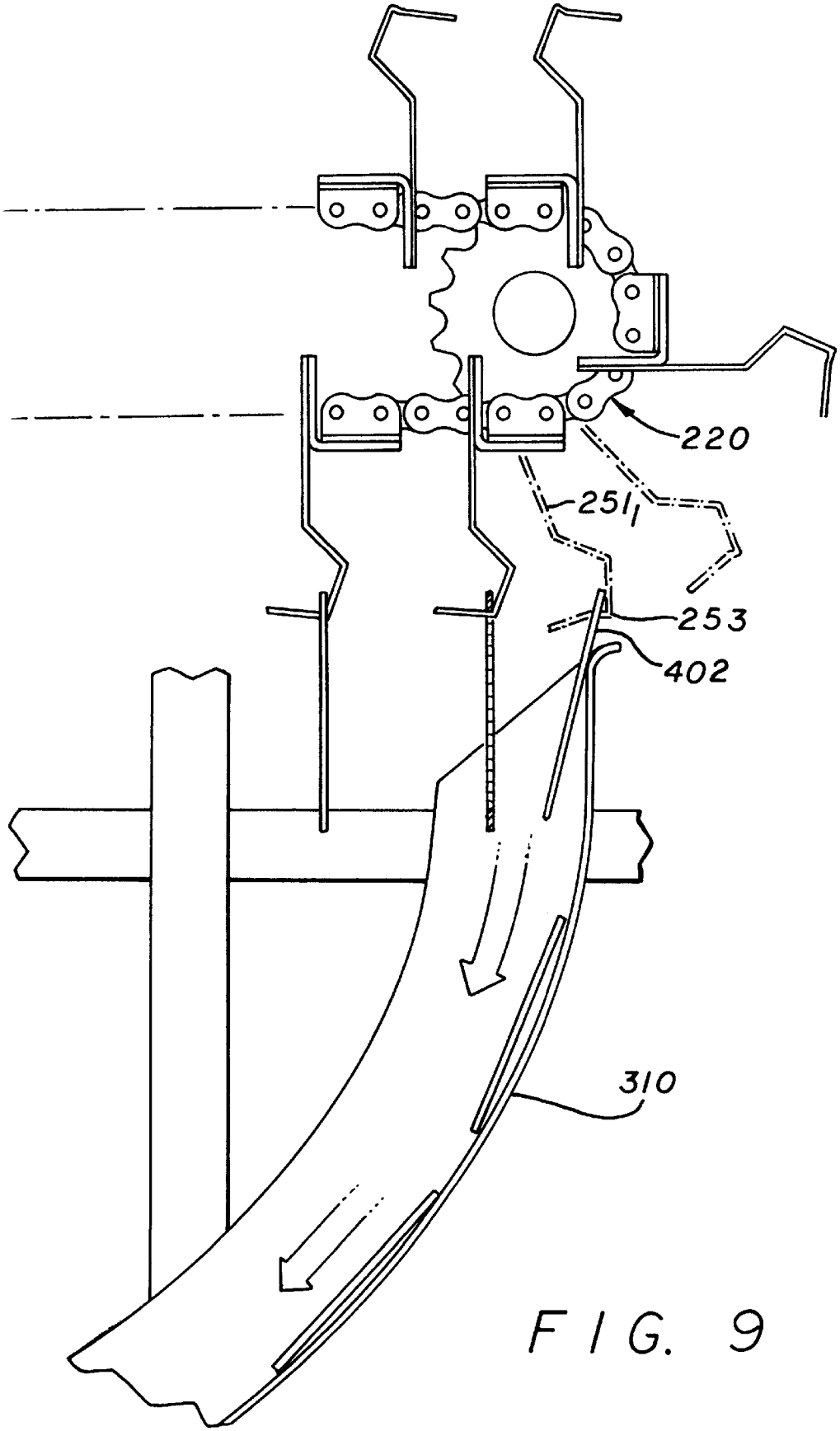
FIG. 9 is a sectional view of the unloading end of the transport system taken along line 9—9 of FIG. 8.

Referring now to FIG. 9, as an article (e.g., article 402) precedes toward chute 310, article 402 is situated at the second recessed portion 253. Upon making contact with chute 310 as hook $\mathbf{251}_1$ is at a first position (denoted by a leftmost dashed line illustration of hook $\mathbf{251}_1$), article 402 begins to shift from second recessed portion 253 of the hook $\mathbf{251}_1$. This shifting continues until article 402 to be completely removed upon hook $\mathbf{251}_1$ upon reaching a second position (denoted by a rightmost dashed line illustration of hook $\mathbf{251}_1$).

While this invention has been described with reference to illustrative embodiments, this description is not intended to be construed in a limiting sense. Various modifications of the illustrative embodiments, as well as other embodiments of the invention apparent to persons skilled in the art to which the invention pertains, are deemed to lie within the spirit and scope of the invention. Thus, the invention should be measured in terms of the claims which follow.

What is claimed is:

1. A transport system comprising:

a plurality of support bars;

a plurality of hooks fastened to each of the plurality of support bars;

a drive mechanism connected to the plurality of support bars; and a drive unit engaged with the drive mechanism, the drive unit causing the drive mechanism to rotate at an adjustable rotational speed in order to convey the plurality of support bars between a first location where each of the plurality of hooks is oriented to receive an article and a second location where the articles are automatically removed from the plurality of hooks;

wherein each of the plurality of hooks is fastened in a selected orientation to engage a respective one of the articles as the respective article is released and falling from a lead screw of an article delivery mechanism.

2. A transport system comprising:

a plurality of support bars;

a plurality of hooks fastened to each of the plurality of support bars;

a drive mechanism connected to the plurality of support bars, wherein the drive mechanism is a plurality of adjustment chains including at least a first adjustment chain and a second adjustment chain; and a drive unit engaged with the drive mechanism, the drive unit causing the drive mechanism to rotate at an adjustable rotational speed in order to convey the plurality of support bars between a first location where each of the plurality of hooks is oriented to receive an article and a second location where the articles are automatically removed from the plurality of hooks.

3. The transport system of claim 2 further including a first drive support supporting the first adjustment chain in order to mitigate a reduction of tension in the first adjustment chain and a second drive support supporting the second adjustment chain.

4. The transport system of claim 2, wherein each of the plurality of support bars is connected to a selected link of the first adjustment chain and a corresponding link of the second adjustment chain.

5. The transport system of claim 2, wherein the drive unit includes:

a rotatable drive shaft; and a plurality of sprockets placed on the drive shaft, wherein each of the plurality of sprockets is engaged with one of the plurality of adjustment chains.

6. The transport system of claim 5, wherein the drive unit further includes a pair of drive adjustment plates to adjust a horizontal positioning of the drive shaft in order to adjust tension of the plurality of adjustment chains.

7. A transport system comprising:

a plurality of support bars;

a plurality of hooks fastened to each of the plurality of support bars;

a drive mechanism connected to the plurality of support bars;

a drive unit engaged with the drive mechanism, the drive unit causing the drive mechanism to rotate at an adjustable rotational speed in order to convey the plurality of support bars between a first location where each of the plurality of hooks is oriented to receive an article and a second location where the articles are automatically removed from the plurality of hooks; and an oven applying heat to the articles during conveyance from the first location toward the second location.

8. A transport system comprising:

a plurality of support bars;

a plurality of hooks fastened to each of the plurality of support bars;

a drive mechanism connected to the plurality of support bars;

a drive unit engaged with the drive mechanism, the drive unit causing the drive mechanism to rotate at an adjustable rotational speed in order to convey the plurality of support bars between a first location where each of the plurality of hooks is oriented to receive an article and a second location where the articles are automatically removed from the plurality of hooks; and an article removal unit situated at the second location, the article removal unit including a chute positioned to make contact with the articles during conveyance in order to cause the articles to be removed from the plurality of hooks.

9. A transport system comprising:

at least one support bar having a plurality of hooks;

a drive mechanism connected to the at least one support bar;

a loading end situated at a first location, including a drive shaft, a drive unit capable of continuously rotating the drive shaft at an adjustable speed, and at least one drive sprocket placed on the drive shaft and engaged with the drive mechanism, the at least one drive sprocket causing the drive mechanism to generally rotate at the adjustable speed in order to convey the at least one support bar from the first location where each of the plurality of hooks of the at least one support bar is oriented to automatically receive an article; and an unloading end situated at a second location in order to remove each article conveyed by the plurality of hooks.

10. The transport system of claim 9, wherein the unloading end includes a complementary shaft;

at least one complementary sprocket placed on the complementary shaft and engaged with the drive mechanism, the at least one complementary sprocket allowing the drive mechanism to generally rotate at the adjustable speed; and an article removal unit placed in close proximity to the complementary shaft to remove each article before returning the at least one support bar to the first location.

11. The transport system of claim 9, wherein each of the plurality of hooks of the support bars is fastened in a selected orientation to engage a respective one of the articles as the respective article is released and falling from a lead screw of an article delivery mechanism.

12. The transport system of claim 9, wherein the drive mechanism is a plurality of adjustment chains including at least a first adjustment chain and a second adjustment chain.

13. The transport system of claim 12, wherein the loading end further includes at least a first drive support supporting the first adjustment chain in order to mitigate a reduction of tension in the first adjustment chain and a second drive support supporting the second adjustment chain.

14. The transport system of claim 12, wherein the at least one support bar is connected to a selected link of the first adjustment chain and a corresponding link of the second adjustment chain.

15. The transport system of claim 12, further includes a pair of drive adjustment plates to adjust a horizontal positioning of the drive shaft in order to adjust tension of the plurality of adjustment chains.

16. The transport system of claim 10, wherein the article removal unit includes a chute positioned to make contact with each article conveyed by the plurality of hooks in order to cause each article to be removed from the plurality of hooks.

17. The transport system of claim 9, wherein an oven is interposed between the loading end and the unloading end, the oven applying heat to each article during conveyance from the loading end to the unloading end and before removal from the plurality of hooks of the at least one support bar.

18. The transport system of claim 9 further comprising an article delivery system operating in synchronism with the loading end to ensure that the plurality of hooks of the at least one support bar are appropriately oriented to receive articles from the article delivery system, wherein the article delivery system includes a plurality of lead screws corresponding in number to the plurality of hooks of the at least one support bar.

19. A transport system comprising:

a plurality of support bars including a plurality of hooks;

a drive mechanism connected to the plurality of support bars;

a drive unit engaged with the drive mechanism, the drive unit causing the drive mechanism to rotate at an adjustable rotational speed in order to convey the plurality of support bars between a first location where each of the plurality of hooks is oriented to receive an article and a second location; and a chute situated at the second location and in close proximity to the drive mechanism, the chute causing removal of the article from one of the plurality of hooks.

* * * * *